US005370346A

United States Patent [19]

Long

[11] Patent Number: 5,370,346

[45] Date of Patent: Dec. 6, 1994

[54] WRIST/FOREARM SUPPORT

[75] Inventor: Michael W. Long, San Luis Obispo, Calif.

[73] Assignee: LMB, Hand Rehab Products, Inc., San Luis Obispo, Calif.

[21] Appl. No.: 7,182

[22] Filed: Jan. 21, 1993

[51] Int. Cl.[5] ..... B43L 15/00

[52] U.S. Cl. ..... 248/118.5; 400/715

[58] Field of Search ..... 248/118, 118.1, 118.2, 248/118.3, 118.5; 400/715

[56] References Cited

U.S. PATENT DOCUMENTS

| | | | |
|---|---|---|---|
| 4,069,995 | 1/1978 | Miller | 248/118.1 |
| 4,332,263 | 6/1982 | Kitrell | 248/118 X |
| 5,056,743 | 10/1991 | Zwar et al. | 248/118 |
| 5,074,501 | 12/1991 | Holtta | 248/118.3 |
| 5,135,190 | 8/1992 | Wilson | 248/118.1 |
| 5,161,760 | 11/1992 | Terbrack | 248/118 |
| 5,265,835 | 11/1993 | Nash | 248/118 |

*Primary Examiner*—Ramon O. Ramirez

*Attorney, Agent, or Firm*—George F. Bethel; Patience K. Bethel

[57] ABSTRACT

A free standing, surface slidable cushioned support member defining an open channel sized to cup and support the wrist or forearm of a user.

12 Claims, 2 Drawing Sheets

WRIST/FOREARM SUPPORT

BACKGROUND OF THE INVENTION

1. Field of the Invention

This invention relates to the field of wrist and forearm supports and especially to a moveable support which is useable in pairs or singly on a right or a left wrist and/or forearm while providing unrestricted slidable and rotational movement.

2. Description of the Prior Art

In recent years the increased use of computer keyboards, computer mice, as well as the repetitive hand and wrist motions required in assembly plants, for example, in soldering, have resulted in the increased incidence of wrist and shoulder strain and particularly of carpal tunnel disorders. These disorders have caused an increase in occupational illness and consequent increased cost to employers and employees in the form of lost earnings and expenses for medical costs and treatment.

In an effort to reduce these problems with respect to keyboard operators, there has been provided a pad for use in front of a keyboard in order to provide a rest for the wrist. The drawback of the pad is that it is flat and during use provides pressure across the under portion of the wrist where carpal tunnel disorders occur. Moreover, the use of the rest is limited to the keyboard itself. This is due to the fact that it is non-movable relative to the keyboard.

SUMMARY OF THE INVENTION

It has now been discovered that a freestanding, slidable, individual wrist/forearm support can provide significant advantages over the stationary, flat support pad of the prior art. The wrist/forearm support of the invention is relatively small in size having a base member upon which is secured a contoured member which is adapted for cupping around or partially enclosing the wrist or any portion of the forearm of a user.

Preferably, the wrist/forearm support has a length which is sufficient to contact only a portion of the distance of the user's wrist or forearm.

The advantage of a small length support is that the pressure along the forearm can be easily varied by movement of the forearm of a user lengthwise with respect to the wrist/forearm support.

The unrestricted surface slidable and rotational movement which the invention support provides also allows the most comfortable bend of the elbow to place the forearm in the best position for strain free use of the fingers.

At the same time, the invention support easily can be slid across a desk or other table surface for access to other machinery or parts as needed. This can be readily done without lifting the wrist or forearm.

A particular advantage of the wrist/forearm support of the invention is the fact that it forms a ramp or incline plane according to its most preferred embodiment. This feature provides a natural, ergonomically correct lift to the wrist and forearm so that a user can avoid holding the hand in a suspended position or raising the shoulder in an unnatural manner. This feature helps to reduce wrist fatigue which can lead to carpal tunnel syndrome and tendonitis.

At the same time, by using the support in reverse, the wrist and forearm of a user are slanted or angled downwardly which can be advantageous for some applications.

Another feature of the wrist/forearm support of the invention is that it is provided with sliding means such as a plurality of tabs or buttons for purposes of facilitating sliding across various surfaces.

Also, the wrist/forearm support can be manufactured in two parts or alternately as a unitary, injection molded or carved block which is provided with a cushioning material. Most preferably, the support can be provided with a malleable cupping member for individual adjustment to provide the most comfortable size for an individual user.

The wrist/forearm support can be used singly and interchangeably for a left or a right wrist or forearm support. This would be particularly advantageous for soldering, computer mouse use and the like. In other instances, a pair of the wrist/forearm supports would be advantageously used to support both a right and a left wrist or forearm of a user. This could be particularly advantageous for word processing or other data entry as well as for used in assembly plants.

If desired, the supports can be of a length to extend substantially from the wrist to the elbow of a user, although this embodiment is less preferred.

BRIEF DESCRIPTION OF THE DRAWINGS

The invention will be more clearly understood by reference to the description below taken in conjunction with the accompanying drawings wherein.

DETAILED DESCRIPTION OF THE DRAWINGS

Figure 1:
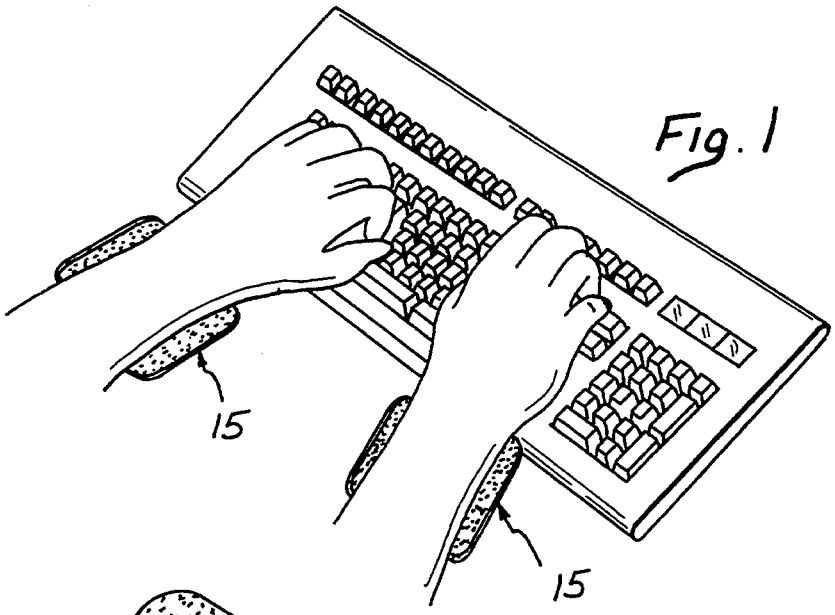
FIG. 1 shows a pair of wrist/forearm supports during computer keyboard use.

Referring now to FIG. 1 there is shown a pair of the wrist/forearm supports 15 of the invention being utilized by a computer keyboard operator. It can be seen that the wrist/forearm supports are positioned at a comfortable angle for the user. In this instance the angle corresponds to the natural bend of the elbow. If it is desired to access something away from the keyboard, the user can simply slide the support 15 across the desk in any direction and even horizontally rotate the support and return as needed. All the while this movement is taking place, the wrist/forearm is being supported.

In the embodiment shown in FIG. 1, the user has positioned the support 15 under the wrist portion of the forearm. A particular advantage of the invention is the fact that the user can move his forearm lengthwise forward or backward relative to the support to provide support to various parts of the forearm. At the same time, extended pressure for long periods on any portion of the wrist or forearm can be avoided.

Figure 4:
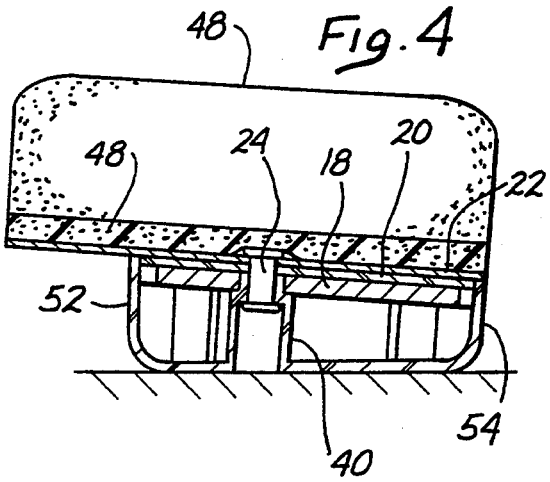
FIG. 4 shows a cross section taken along the lines 4—4 of FIG. 3.
Figure 2:
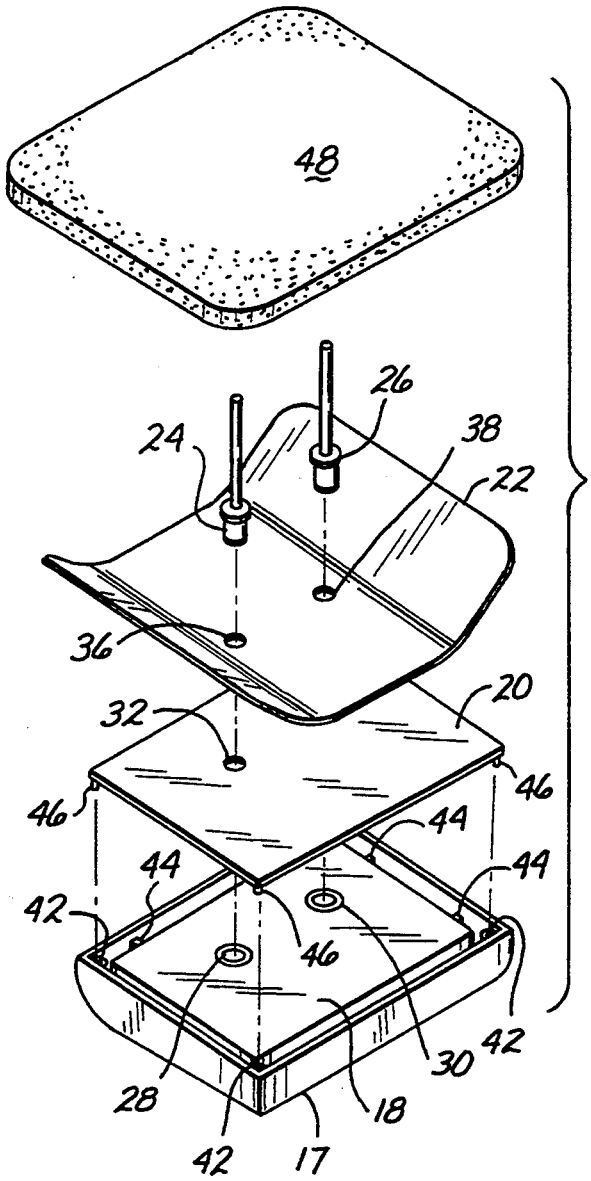
FIG. 2 shows an exploded view of the various interconnecting parts of a preferred embodiment of the wrist/forearm support of the invention.

An exploded perspective view of the most preferred embodiment is shown in FIG. 2. The support 15 is anchored by a substantially open base member 17. Base member 17 is provided with a pair of spaced apart upwardly extending substantially cylindrical collars 40 and 41 as shown in FIG. 4 and an upwardly extending tubular socket 42 disposed at each of the four corners. In addition, base member 17 has a plurality of braces 44 disposed adjacent the interior walls.

A weighted plate 18 having openings 28 and 30 fit over the collars 40 and 41 and the plate is supported by the braces 44. A cover 20 having openings 32 is provided with cylindrical flanges or pins 46 which are snap fitted into tubular sockets 42 of base member 17 while the openings 32 are aligned with openings 28 and 30 of plate 18.

Overlying cover 20 is a malleable metal plate 22 which is provided with openings 36 and 38 which are aligned with openings 32 of cover 20. A pair of rivets 24 and 26 pass through the aligned openings respectively of 36, 32, 28, 40 and 38, 32, 30, 40 to secure together the malleable metal plate 22, cover 20, weighted plate 18, and base member 17. The tops of the rivets 24 and 26 are secured after emplacement.

Bolts, screws and other fastening devices can be used in place of the rivets 24 and 26. Or, if desired, the parts of the support 15 can be held together with a strong adhesive.

A piece of cushioning material 48 is adhered to the malleable metal plate 22 with an adhesive or other convenient means.

When assembled, the malleable metal plate 22 with its covering of cushioning material 48 can be manually bent to the desired curve in order to provide individual adjustment. Generally, this is in the form of a shallow cup shape.

Figure 5:
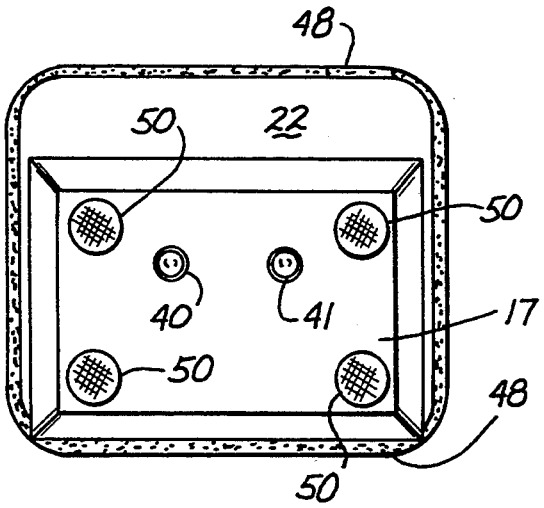
FIG. 5 shows a view of the underside of the wrist/forearm support of FIG. 3.

Referring now to FIG. 5, the underside of the base member 17 can be seen. As shown, the base member 17 has a bevel around the peripheral edge. In addition, the base member 17 has four circular tabs 50 made of a resilient looped material. The purpose of the tabs 50 is to facilitate sliding of the base member 17 over smooth surfaces such as a table or desk top. The tabs 50 are not necessary since as the base member 17 can be provided with a smooth surface. However, it has been found that improved ease in sliding is achieved with the tabs 50 without marring the table or desk top.

Nylon tabs or buttons can be used in place of the tabs 50. Alternately, ball bearings or other sliding means can be used which will be obvious to those skilled in the art.

Figure 3:
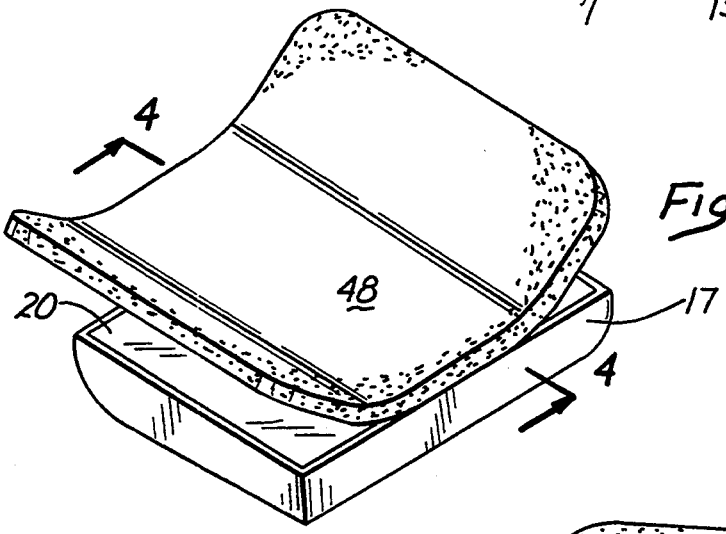
FIG. 3 shows the wrist/forearm support of the invention in its assembled condition.

Referring now to FIGS. 3 and 4, it can be seen that the base member 17 is higher at one end 52 than at its opposite end 54. This angle or wedge shape provides a particularly desirable angle to the wrist/forearm of a user. The slight lift provided to the wrist/forearm provides an ergonomically correct angle to the wrist and forearm to minimize fatigue and strain. While this angle to the base is preferred, it is not absolutely necessary. Also, the support can also be used to provide a downward slant or angle to a wrist or forearm for specialized applications such as in assembly work.

Thus, the support of the invention is adaptable for use in a wide variety of activities such as clerical, manufacturing and engineering.

Figure 6:
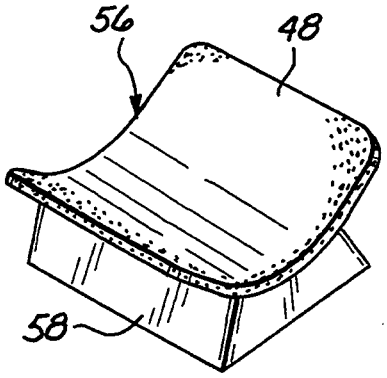
FIG. 6 shows a solid block embodiment of the wrist/forearm support with a cushioning pad thereon; and, FIG. 7 shows an elongated embodiment of the wrist/forearm support.

The embodiments shown in FIGS. 1–5 represent the most preferred embodiments. Other embodiments are also contemplated as well. FIG. 6 shows one embodiment showing a wrist/forearm support 56 having a base member 58 which is comprised of a solid or hollow block of material such as plastic or wood having a contoured upper surface onto which a layer of cushioning material 48 is adhered. The embodiment as shown does not have the angled feature of FIGS. 1–5 but the support can be provided with a lift or angle of if desired.

Figure 7:
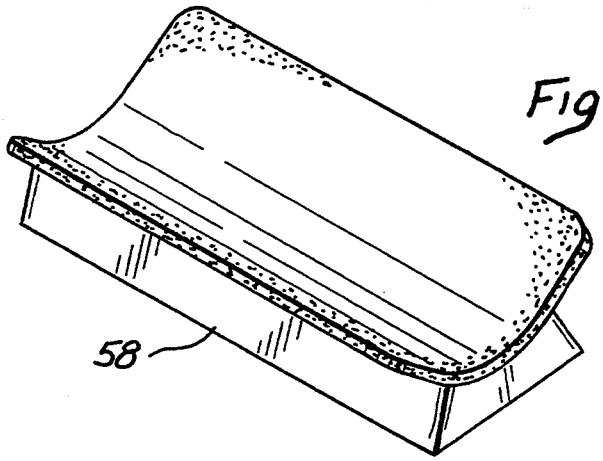

FIG. 7 shows a wrist/forearm support 58 having a longer length than the support 15 shown in FIGS. 1–6. The invention is not limited to the actual length of the support. However, certain advantages are provided with the shorter length, mainly, the ability to vary the position of the wrist and forearm lengthwise to vary the pressure exerted by the support along the wrist and forearm.

Various modifications of the invention are contemplated and can be resorted to without departing from the spirit and scope of the invention as defined by the following claims.

I claim:

1. An independently moveable wrist or forearm support comprising:

a base member having a substantially wedge shape; and, a contoured member secured to said base member, said contoured member having a lengthwise axis and two ends so that when said Contoured member is secured to said base member, said lengthwise axis of sad contoured member is raised at one end of said contoured member relative to its opposite end, wherein said contoured member is sized to accommodate the width of the forearm of a user and is formed of a malleable material having an overlayment of flexible cushioning material for cushioned contact with a wrist or forearm of a user so that said contoured member can be adjusted by bending to accommodate different contoured widths and depths.

2. A pair of supports according to claim 1 for support of a right wrist or forearm and a left wrist or forearm of a user.

3. A support according to claim 1 wherein said support is sized along its length to extend only a portion of the distance between the wrist and elbow of an user.

4. A support according to claim 1 wherein said support is sized to provide a length which will extend substantially from the wrist to the elbow of a user.

5. A support according to claim 1 wherein said base member is weighted.

6. A support according to claim 1 wherein said base member is provided with means to facilitate gliding across a surface.

7. A support according to claim 6 wherein said gliding means comprises at least one tab secured to said base member.

8. A support according to claim 1 wherein said support is comprised of plastic.

9. A support according to claim 1 wherein said support is weighted and further includes a bottom surface having at least one tab to provide sliding means to said support.

10. A support according to claim 9 wherein said sliding tabs are integrally formed therein.

11. A free standing, surface slidable support member defining a cradle for a wrist or forearm which is formed in two separate pieces including a base member having means for facilitating sliding across a surface and an upper member formed of a malleable material for individual adjustment of size defining a trough adapted for support of a wrist or forearm of a user, said trough-shaped upper member including cushioning material.

12. A support according to claim 11 wherein said malleable material is comprised of a metal.

* * * * *